United States Patent [19]

Matsuo

[11] 4,386,993

[45] Jun. 7, 1983

[54] HEATING PRESS-ON APPARATUS FOR TRANSFER MARKS

[76] Inventor: Mototsugu Matsuo, 4-36, 2-chome, Nakazakinishi, Kita-ku, Osaka-shi, Japan

[21] Appl. No.: 335,671

[22] Filed: Dec. 30, 1981

[30] Foreign Application Priority Data

Apr. 30, 1981 [JP] Japan ..... 56-64270[U]

[51] Int. Cl.[3] ..... B30B 5/02

[52] U.S. Cl. ..... 156/358; 38/39; 100/93 D; 100/282; 156/359; 156/583.3

[58] Field of Search ..... 156/583.6, 583.7, 583.8, 156/583.9, 358, 359; 100/233, 282, 93 D; 38/36–41; 219/211, 243

[56] References Cited

U.S. PATENT DOCUMENTS 1,426,120 8/1922 Spencer et al. ..... 38/39 X 1,666,734 4/1928 Clisson ..... 38/39

1,689,473 10/1928 Brockett ..... 38/39

3,979,248 9/1976 Kussmaul ..... 156/583.9 X

*Primary Examiner*—David A. Simmons

*Attorney, Agent, or Firm*—Wenderoth, Lind & Ponack

[57] ABSTRACT

An apparatus for heat pressing transfers onto substracts, such as cloth. The device has a horizontal table with a rocking member pivoted at an intermediate portion of a housing and extending from inside to the outside of the housing with a heater plate mounted on the upper end of the rocking member and adapted to engage the table. A cam is fixed to an output shaft within the housing and a ring is placed around the cam for being oscillated by the rotation of the cam, and connecting arms are connected between the ring and the rocking member. A pair of switch actuators is provided on the ring to engage a pair of limit switches for limiting the rotation of the drive shaft for the cam in opposite directions.

3 Claims, 7 Drawing Figures

HEATING PRESS-ON APPARATUS FOR TRANSFER MARKS

This invention relates to a heating press-on apparatus for transferring to cloth products or the like transfer marks comprising letters or patterns formed on cloth coated at one surface with an adhesive, or those formed of short fibre stuck temporarily to one surface of a base sheet, such as paper, and coated with an adhesive.

A heating press-on apparatus for transferring various marks has been disclosed by Japanese Utility Model Publication No. Sho 53-27974, which apparatus has a heater plate fixed to an arm which is connected through a link to a vertically-rocking plate pivoted at one end, the heater plate being vertically movable by a handle fixed to the rocking plate. In other words, it is a considerably hard work for a worker that the heater plate of a considerably heavy weight should be moved vertically through the rocking plate. Also, the heater plate should be placed on a pedestal horizontally fixedly provided, in which there is a defect that an applied pressure is restricted in increment.

This invention enables the heater plate to move vertically by use of an electric motor so as to facilitate vertical operation of the heater plate, and can utilize power from the motor to apply a sufficient pressure on the heater plate placed on the table, thereby ensuring the press of transfer marks with respect to cloths or the like.

Figure 1:
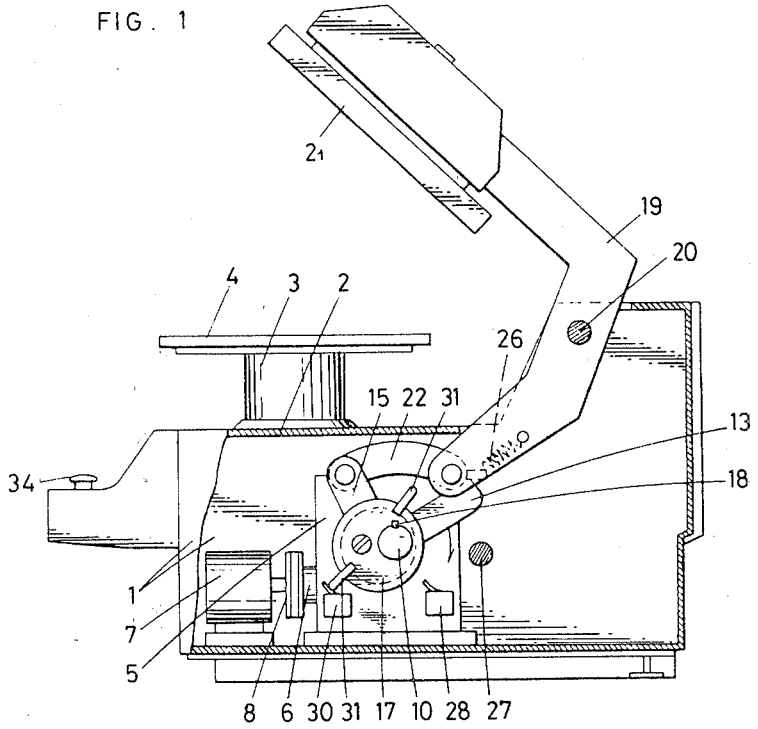
Figure 2:
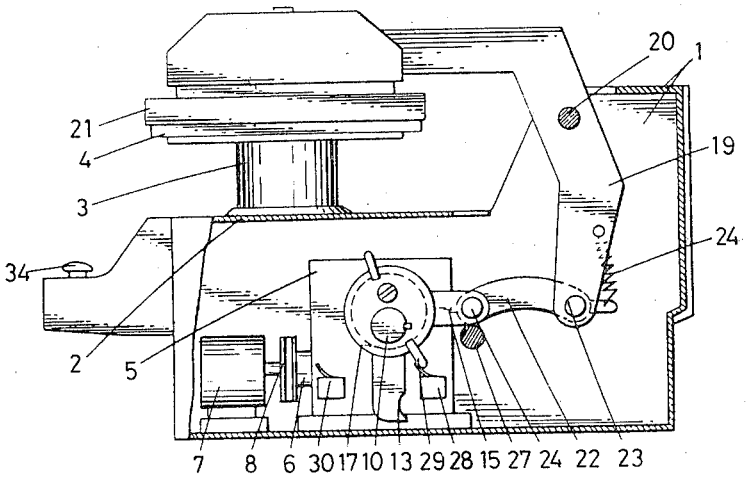
Figure 3:
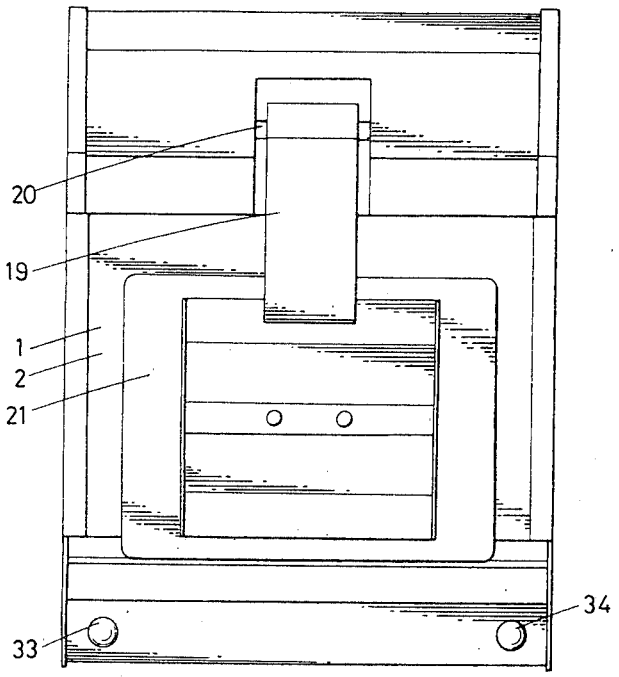
Figure 4:
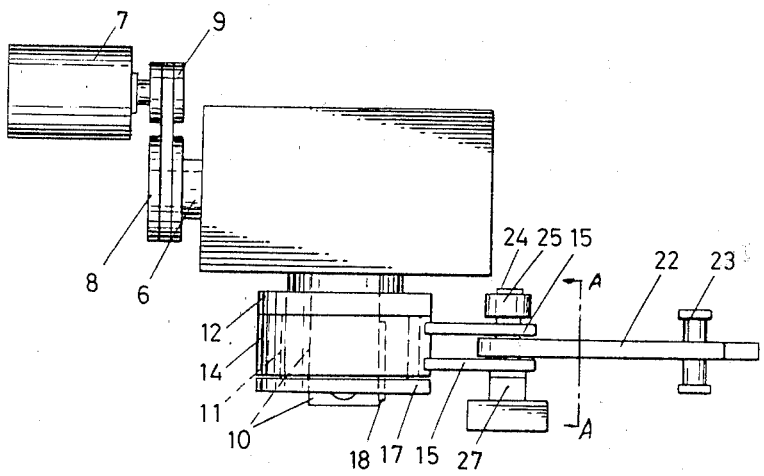
Figure 5:
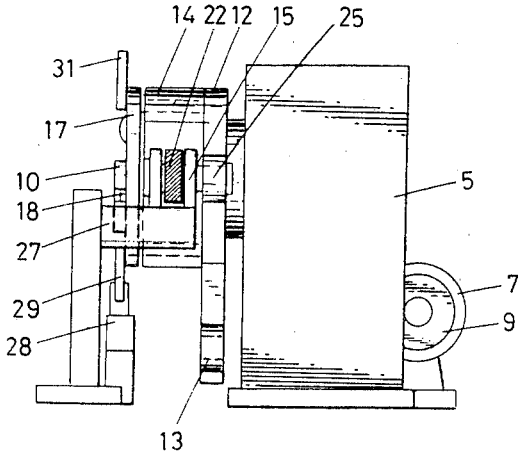
Figure 6:
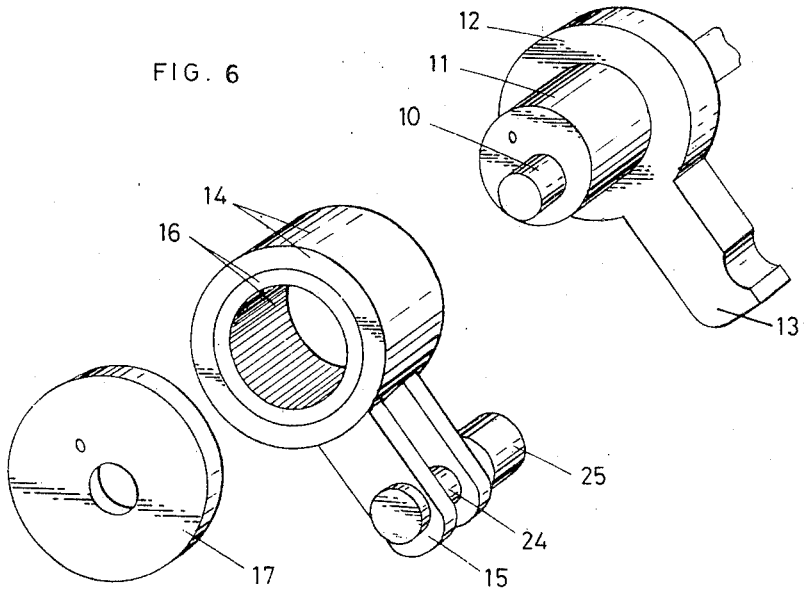
Figure 7:
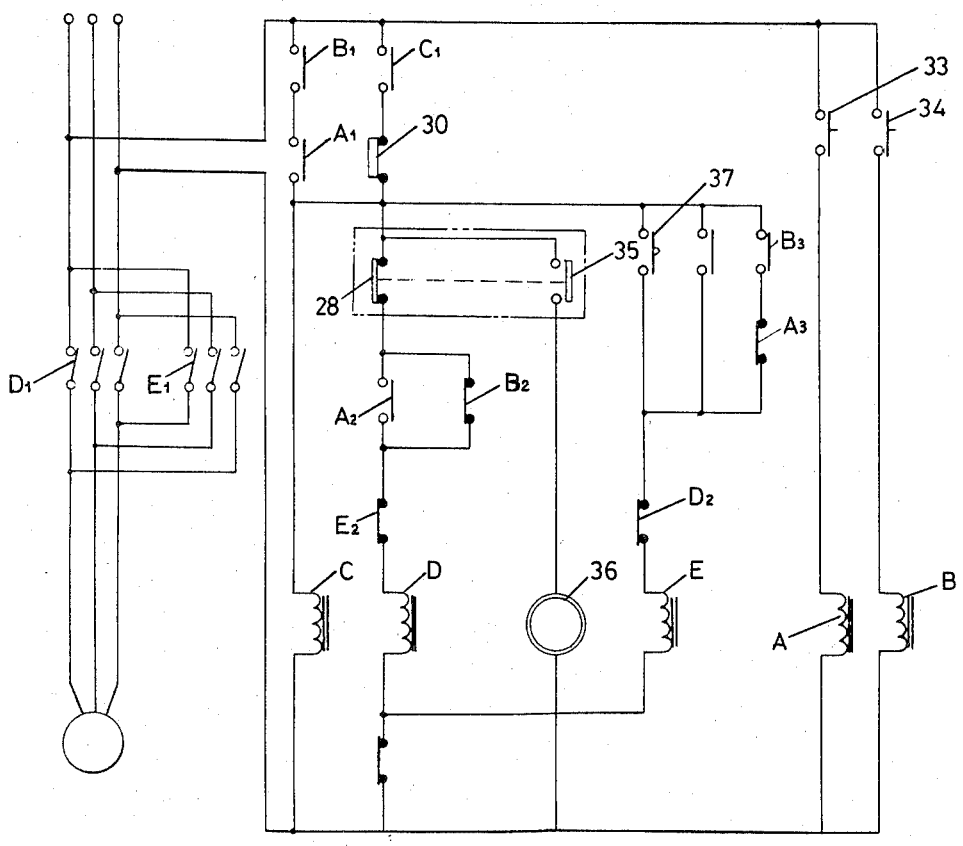

An embodiment of a heating press-on apparatus of the invention is shown in the drawings, in which FIG. 1 is a sectional side view of the apparatus, showing a heater plate lifted, FIG. 2 is a sectional side view of the same, showing the heater plate lowered, FIG. 3 is a plan view of FIG. 1 embodiment, FIG. 4 is an enlarged plan view of a reduction gear, FIG. 5 is a sectional view taken on the line A—A in FIG. 4, FIG. 6 is a perspective exploded view of a cam portion, and FIG. 7 is a wiring diagram of the apparatus of the invention.

Next, an embodiment of a heating press-on apparatus of this invention will be detailed in accordance with the accompanying drawings, in which 1 is a box-shaped housing and a table 4 is fixed horizontally on a pedestal 3 fixed to the upper wall 2 of housing 1.

5 is a reduction gear provided within housing 1, which comprises worm gears in mesh, its input shaft 6 being driven by a motor 7. 8 is a pulley fixed to input shaft 6, and 9 is a pulley fixed to a shaft of motor 7, the pulleys 8, 9 being connected with a belt to allow the input shaft 6 to rotate by the motor 7. 10 is an output shaft of reduction gear 5, which fixes a cam 11 which is formed of a rod round in section and disposed parallel in the axis to the shaft 10 and shifted at the axis therefrom. 12 is a support disc fixed to the cam 11 or output shaft 10 at the output shaft 10 base side, the disc 12 being larger in diameter than the cam 11. 13 is a support arm fixed to the support disc 12 and projecting radially therefrom. The support arm 13 is preferred to be provided at a position where an interval between the outer periphery of support disc 12 and the output shaft 10 is minimized, but may be positioned apart at a proper angle from the position where an interval between the same becomes maximum. 14 is a ring disposed freely rotatably onto the outer periphery of cam 11, and at the outer periphery of ring 14 are fixed connected arms 15 projecting radially thereof, in which it is preferable to interpose a bearing 16, such as a needle bearing, between the inner periphery of ring 14 and the outer periphery of cam 11, thereby making smooth mutual rotations thereof. 17 is a disc equal in an outer diameter to the ring 14 and fixed to cam 11 at the utmost end of output shaft 10 to thereby prevent the ring 14 from escaping from the cam 11. For example, the cam 11 projects at one end slightly from the ring 14 so that the disc 17 is fixed to the cam 11, thereby preventing an escape of ring 14 and allowing the ring 14 to be freely rotatable. 18 is a key for fixing the cam 11 to output shaft 10.

19 is a rocking member of a hook-shaped rod, which is inserted at the lower end into housing 1, projects at the upper end outwardly therefrom, and is pivoted at an intermediate portion to housing 1 through a spindle 20, thereby being vertically swingable. 21 is a heater plate fixed to the upper end of rocking member 19, which can be put upon the table 4, whereby the housing 1 is formed to strongly withstand the weight of heater plate 21. 22 is a connecting rod mounted at one end to rocking member 19 through a shaft 23 and journalled at the other end to the utmost ends of arms 15, the rod 22, in this embodiment, bending in a circular arc, may alternatively be straight. A shaft 24 projects largely from one connecting arm 15 toward support disc 12 and carries a bearing 25, such as ball bearing, and the position of bearing 25 and length of support arm 13 are determined so that the support arm 13, when the support disc 12 rotates, abuts at the lateral surface in the rotation direction of support arm 13 against the outer periphery of bearing 25. 26 is a spring stretched across an end of connecting rod 22 at the shaft 23 side and the rocking member 19, the spring 26 biasing the connecting rod 22 upwardly.

27 is a stopper provided horizontally at the position where the connected arm 15 only is placed on the stopper 27 when the heater plate 21 contacts with table 4. 28 is a limit switch for a down, which detects the lowering of heater plate 21, in other words, detects the heater plate 21 being placed on the table 4 and the output shaft 10 rotating at a proper angle, and is operated by a contact 29 fixed to disc 17. 30 is a limit switch for an up, which detects a rise of heater plate 21 to a given height by rocking member 19 and is operated by a contact 31 fixed to disc 17.

This apparatus constructed as foregoing, after transfer marks are transferred to cloth products or the like, raises the heater plate 21 above the table 4 as shown in FIG. 1, by rotating the motor 7 to allow the support arm 13 to raise the connected arms 15 through shaft 24. Cloth products and others, on which transfer marks are to be transferred, are placed in layers onto the table 4 and a switch, such as a push button switch, is on to rotate the motor 7. The rotation thereof is reduced in speed by reduction gear 5 to rotate the output shaft 10 at low speed in the direction of the arrow in FIG. 1. Simultaneously with the rotation of output shaft 10, the cam 11, support disc 12, and disc 17, rotate to lower the support arm 13, whereby the heater plate 21 lowers while swinging the rocking member 19 and is placed on table 4 as shown in FIG. 2.

On the other hand, upon lowering the heated plate 21 to swing the rocking member 19, the ring 14 together with connecting arm 15 is rotated through connecting rod 22. The connecting arms 15, when the heater plate 21 is placed on table 4 and the rocking member 19 stops, contact with stopper 27 and stops, and also the ring 14 stops it rotation. However, the output shaft 10, cam 11, support disc 12, support arm 13, and disc 17, continue to rotate, so that the outer peripheral portion of cam 11 in contact with ring 14 at its position where the connecting arm 15 is provided, moves sequentially largely away from output shaft 10. Hence, the cam 11 moves the connecting arms 15 toward rocking member 19 through the stationary ring 14, whereby the rocking member 19 is moved at its lower end rightwardly in FIG. 2, thus urging the heater plate 21 onto table 4 to intensely press the cloth products and transfer marks to be transferred thereon. When the cam 11 properly presses them, the contact 29 contacts with limit switch 28 to stop the motor 7, thus proceeding the transfer work.

After the lapse of a proper time, the motor 7 is reversely rotated, then the support arm 13 abuts against bearing 25 and raises the connecting arms 15 together with ring 14 through shaft 24 to the condition in FIG. 1, thereby lifting the heater plate 21. Upon rising of heater plate 21, a contact 31 operates limit switch 30 to stop the motor 7, thereby keeping the heater plate 21 lifted.

In this example, the bearing 25 is mounted on shaft 24 and abuts against support arm 13, the bearing 25 may be omitted. A pivot separate from shaft 24 may alternatively be provided at the lateral side of connecting arm 15 and abut against support arm 13, the contacts 29 and 31 being enough to be fixed to a member rotatable together with output shaft 10. The support arm 13 may be used as the contacts 29 and 30.

FIG. 7 is a wiring diagram exemplary of normal and reverse rotations of motor 7, in which the switches shown by white circles are normally off and those by black circles are normally on. In the FIG. 7 example, for lowering the heater plate 21, button switches 33 and 34 of non-lock type are pushed simultaneously by operator's both hands. Then, relay coils A and B turn relay switches A1 and B1 on and actuate a self-maintaining type relay coil C to turn a relay switch C1 on. Since the relay coils A and B keep relay switches A2 and B3 on and relay switches B2 and A3 off, relay coil D is on and turns relay switch D1 on and relay switch D2 off, whereby relay coil E to reversely rotate the motor 7 is not operative. Hence, the motor 7 normally rotates to lift the heater plate 21.

When the motor 7 normally rotates and the contact 29 turns the limit switch 28 off, the relay switch D1 is off to stop the motor 7. When the limit switch 28 is off, a switch 35 is on and a timer 36 operates, and after the lapse of a given time, a timer switch 37 is on and a relay coil E turns relay switch E1 on and that E2 off, thereby reversely rotating the motor 7 and lifting the heater plate 21. Upon lifting the heater plate 21, the contact 31 turns the limit switch 30 off to stop the motor 7.

This circuit also can lift the heater plate 21 on the way of lowering thereof. In this instance, the push button switch 34 only is pushed, then relay coil B turns relay switch B2 off to cut off the relay coil D circuit and turn relay switch D1 off to thereby stop the motor 7. On the other hand, since relay switch B3 is on, relay coil E operates to turn relay switch E1 on and that E2 off, whereby the motor 7 reversely rotates to lift the heater plate 21. Therefore, the transfer marks can be prevented from being molten by mistake and safety is improved.

As seen from the above, the apparatus of this invention rotates the motor 7 normally and reversely to move the heater plate 21 up and down to thereby facilitate operation of heater plate 21. Since the cam 11 is fixed to output shaft 10 and the rocking member 19 is connected through connecting rod 22 to connecting arms 15 projecting from ring 14 provided freely rotatably at the outer periphery of cam 11, an offset amount of cam 11 or a rotary angle of output shaft 10, is properly defined to make it possible to press the heater plate 21 onto the table 4 under desired pressure and ensure neat transfer of the marks onto cloth products of optimum thickness.

Since the motor 7 moves the heater plate 21 up and down, if the time for lowering it, is set in a timer, the motor 7, after the lapse of a given time, also can reversely rotate to lift the heater plate 21, thereby enabling the press work to proceed effectively at a constant time for press work.

Also, the reduction gear 5 uses gears, such as worm gears, in mesh, so that there is no fear that the output shaft 10 happens to rotate during a stop of motor 7, thereby reliably lifting the heater plate 21 and keeping it lifted and being usable in safety.

What is claimed is:

1. A heating press-on apparatus for transfer marks, comprising, a table mounted horizontally on the upper portion of a housing, a rocking member pivoted at an intermediate portion thereof to said housing and extending from the inside to the outside of said housing, a heater plate mounted on the upper end of said rocking member and to be placed on said table, a round-rod-shaped cam being fixed to an output shaft of a reduction gear provided within said housing and extending in a relation that the axes of said output shaft and cam extend in parallel to each other, a ring sleeved rotatably in idling onto the outer periphery of said cam, connecting arms projecting from the outer surface of said ring diametrically thereof, a support arm fixed to the outer periphery of a support disc rotatable together with said cam and projecting diametrically of said support disc at the position where said output shaft most approaches the outer periphery of said support disc, a connecting rod pivoted at one end thereof to said connecting arms and at the other end to the lower end of said rocking member, a shaft projecting from the lateral side of one of said connecting arms and supported by said support arm at one side thereof in its rotating direction, a stopper extending horizontally and for supporting said connecting arms when said heater plate is placed on said table, a limit switch for detecting rotation of said output shaft further at a desired angle after said connecting arms are supported by said stopper, thereby bringing to a half an electric motor which drives an input shaft of said reduction gear, and a limit switch which detects said support arm lifting said heater plate and brings said motor to a halt.

2. A heating press-on apparatus for transfer marks according to claim 1, wherein a bearing is interposed between the opposite surfaces of said output shaft and ring.

3. A heating press-on apparatus for transfer marks according to claim 1, wherein said support arm projects from said support disc at the position where said output shaft approaches the outer periphery of said support disc at the smallest interval.

* * * * *